US010753209B2

(12) United States Patent
Neeli et al.

(10) Patent No.: US 10,753,209 B2
(45) Date of Patent: Aug. 25, 2020

(54) TURBINE DISC ASSEMBLIES AND METHODS OF FABRICATING THE SAME

(71) Applicant: General Electric Company, Schenectady, NY (US)

(72) Inventors: Sudhakar Neeli, Karnataka (IN); Sanjeev Kumar Jain, Karnataka (IN)

(73) Assignee: General Electric Company, Schenectady, NY (US)

( * ) Notice: Subject to any disclaimer, the term of this patent is extended or adjusted under 35 U.S.C. 154(b) by 937 days.

(21) Appl. No.: 15/189,654

(22) Filed: Jun. 22, 2016

(65) Prior Publication Data

US 2017/0159441 A1 Jun. 8, 2017

Related U.S. Application Data

(63) Continuation-in-part of application No. 15/179,594, filed on Jun. 10, 2016.

(30) Foreign Application Priority Data

Dec. 3, 2015 (PL) ..... 415045

(51) Int. Cl.
*F01D 5/08* (2006.01)
*F01D 5/18* (2006.01)
(Continued)

(52) U.S. Cl.
CPC ..... *F01D 5/187* (2013.01); *F01D 5/066* (2013.01); *F01D 5/08* (2013.01); *F01D 5/081* (2013.01);
(Continued)

(58) Field of Classification Search
CPC ..... F01D 5/087; F01D 5/066; F01D 5/082; F01D 5/085
See application file for complete search history.

(56) References Cited

U.S. PATENT DOCUMENTS 2,973,938 A * 3/1961 Alford ..... F01D 5/085 416/96 R
3,689,176 A * 9/1972 Howell ..... F01D 5/3015 416/96 R
(Continued)

FOREIGN PATENT DOCUMENTS

DE 3436340 A1 4/1986
FR 2406121 A1 5/1979
(Continued)

OTHER PUBLICATIONS http://www.ccj-online.com/know-your-7ea-turbine-a-backgrounder-for-newcomers/, Nov. 30, 2015, 2 pages.
(Continued)

*Primary Examiner* — Kayla Mccaffrey
(74) *Attorney, Agent, or Firm* — Armstrong Teasdale LLP

(57) ABSTRACT

A turbine disc assembly is provided. The turbine disc assembly includes a first rotor disc, a second rotor disc, and a spacer disc coupled between the first and second rotor discs along an axis to define a plenum. The spacer disc has an inner surface with a radius from the axis. A first cooling channel defined between the first rotor disc and the spacer disc is in flow communication with the plenum. The second rotor disc includes a deflector having a deflection surface positioned within the plenum such that the deflection surface is oriented towards the first cooling channel at an acute angle relative to the radius of the inner surface of the spacer disc.

17 Claims, 3 Drawing Sheets

(51) Int. Cl.
*F01D 5/06* (2006.01)
*F01D 9/02* (2006.01)

(52) U.S. Cl.
CPC ..... *F01D 5/082* (2013.01); *F01D 5/085* (2013.01); *F01D 5/087* (2013.01); *F01D 5/18* (2013.01); *F01D 9/02* (2013.01); *F05D 2220/32* (2013.01); *F05D 2230/00* (2013.01); *F05D 2250/71* (2013.01); *F05D 2260/202* (2013.01)

(56) References Cited

U.S. PATENT DOCUMENTS

| | | | | |
|---|---|---|---|---|
| 4,880,354 | A * | 11/1989 | Teranishi | F01D 5/08 416/95 |
| 5,127,799 | A * | 7/1992 | Berry | F01D 11/005 277/648 |
| 5,997,244 | A | 12/1999 | Gebre-Giorgis et al. | |
| 6,210,116 | B1 | 4/2001 | Kuczaj et al. | |
| 6,382,903 | B1 | 5/2002 | Caruso et al. | |
| 6,398,487 | B1 | 6/2002 | Wallace et al. | |
| 6,537,030 | B1 | 3/2003 | Garrison | |
| 7,210,226 | B2 | 5/2007 | Makinson et al. | |
| 7,708,519 | B2 | 5/2010 | Mignano | |
| 8,061,031 | B2 | 11/2011 | Ranz et al. | |
| 8,074,647 | B2 | 12/2011 | Truitt et al. | |
| 8,348,599 | B2 | 1/2013 | Chiu et al. | |
| 8,556,584 | B2 | 10/2013 | Mallaiah et al. | |
| 9,890,645 | B2 * | 2/2018 | McCaffrey | F01D 5/082 |
| 10,260,524 | B2 * | 4/2019 | Hiester | F04D 25/045 |
| 2001/0025476 | A1 | 10/2001 | Eldrid et al. | |
| 2009/0047133 | A1 | 2/2009 | Nishino | |
| 2011/0236190 | A1 | 9/2011 | Chiu et al. | |
| 2013/0343868 | A1 | 12/2013 | Jha et al. | |

FOREIGN PATENT DOCUMENTS

| | | | |
|---|---|---|---|
| GB | 2295861 | A | 6/1996 |
| IT | 1212263 | B | 11/1989 |
| JP | 63253125 | A | 10/1988 |

OTHER PUBLICATIONS http://freeliff.com/radial-inflow-turbines/, Nov. 30, 2015, 8 pages.
https://en.wikipedia.org/wiki/Centrifugal_compressor, Nov. 30, 2015, 22 pages.
Poland Patent Office Search Report for Patent Application No. P-415045, 1 page.

* cited by examiner

TURBINE DISC ASSEMBLIES AND METHODS OF FABRICATING THE SAME

CROSS-REFERENCE TO RELATED APPLICATIONS

This application claims the benefit of U.S. Non-Provisional patent application Ser. No. 15/179,594 filed on Jun. 10, 2016 and Polish Patent Application No. P-415045 filed on Dec. 3, 2015, which are incorporated by reference herein in their entirety.

BACKGROUND

The field of this disclosure relates generally to turbine discs and, more particularly, to a turbine disc assembly and methods of fabricating the same.

Many known gas turbine assemblies include a compressor, a combustor, and a turbine. Gases (e.g., air) flow into the compressor and are compressed. The compressed gas flow is then discharged into the combustor, mixed with fuel, and ignited to generate combustion gases. The combustion gas flow is channeled from the combustor through the turbine.

At least some known turbines include a plurality of rotor blades that are driven by the combustion gas flow. As such, the rotor blades are generally subjected to higher-temperature operating conditions than other portions of the turbine assembly. To facilitate preventing the rotor blades from overheating, at least some known rotor blades are cooled by channeling a flow of cooling gas through a cooling circuit defined inside of each rotor blade. However, it may be difficult to distribute the cooling gas flow amongst the rotor blades to ensure that each rotor blade is adequately cooled.

BRIEF DESCRIPTION

In one aspect, a turbine disc assembly is provided. The turbine disc assembly includes a first rotor disc, a second rotor disc, and a spacer disc coupled between the first and second rotor discs along an axis to define a plenum. The spacer disc has an inner surface with a radius from the axis. A first cooling channel defined between the first rotor disc and the spacer disc is in flow communication with the plenum. The second rotor disc includes a deflector having a deflection surface positioned within the plenum such that the deflection surface is oriented towards the first cooling channel at an acute angle relative to the radius of the inner surface of the spacer disc.

In another aspect, a method of fabricating a turbine disc assembly is provided. The method includes forming a first rotor disc and forming a second rotor disc such that the second rotor disc includes a deflector having a deflection surface. The method also includes forming a spacer disc such that the spacer disc has an inner surface, and the method further includes coupling the spacer disc between the first and second rotor discs along an axis to define a plenum wherein a radius is defined from the axis to the inner surface of the spacer disc. A first cooling channel defined between the first rotor disc and the spacer disc is in flow communication with the plenum. The deflection surface is positioned within the plenum and is oriented towards the first cooling channel at an acute angle relative to the radius of the inner surface of the spacer disc.

In another aspect, a gas turbine assembly is provided. The gas turbine assembly includes a compressor having a plurality of compressor rotor blades. The gas turbine assembly also includes a turbine having a plurality of turbine rotor blades. Each of the turbine rotor blades has an internal cooling circuit. The gas turbine assembly further includes a rotor shaft rotatably coupling the turbine rotor blades to the compressor rotor blades. The compressor is in flow communication with the internal cooling circuits of the turbine rotor blades across the rotor shaft. The rotor shaft has a turbine segment including a first rotor disc, a second rotor disc, and a spacer disc coupled between the first and second rotor discs along an axis to define a plenum. The spacer disc has an inner surface with a radius from the axis. A first cooling channel is defined between the first rotor disc and the spacer disc such that the first cooling channel is in flow communication with the plenum and the internal cooling circuit of one of the turbine rotor blades. The second rotor disc includes a deflector having a deflection surface positioned within the plenum such that the deflection surface is oriented towards the first cooling channel at an acute angle relative to the radius of the inner surface of the spacer disc.

DETAILED DESCRIPTION

The following detailed description illustrates turbine discs by way of example and not by way of limitation. The description should enable one of ordinary skill in the art to make and use the turbine discs, and the description describes several embodiments of the turbine discs, including what is presently believed to be the best modes of making and using the turbine discs. Exemplary turbine discs are described herein as being coupled within a gas turbine assembly. However, it is contemplated that the turbine discs have general application to a broad range of systems in a variety of fields other than gas turbine assemblies.

Figure 1:
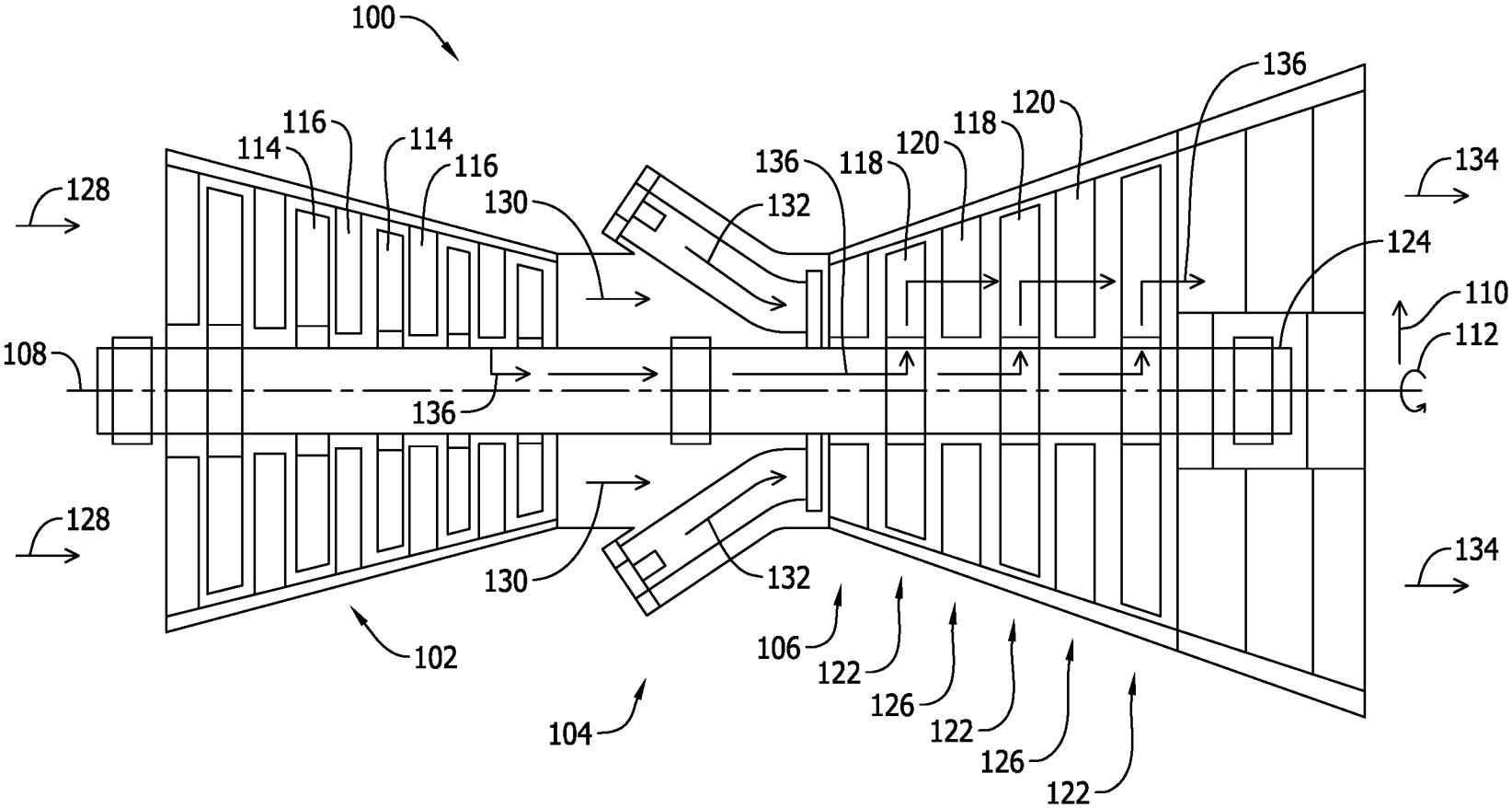
FIG. 1 is a schematic illustration of an exemplary turbine assembly.

FIG. 1 illustrates an exemplary turbine assembly 100. In the exemplary embodiment, turbine assembly 100 is a gas turbine assembly including a compressor 102, a combustor 104, and a turbine 106 coupled in flow communication with one another along a centerline axis 108 such that turbine assembly 100 has a radial dimension 110 that extends from axis 108 and a circumferential dimension 112 that extends around axis 108. As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

In the exemplary embodiment, compressor 102 includes a plurality of rotor blades 114 and a plurality of stator vanes 116, and turbine 106 likewise includes a plurality of rotor blades 118 and a plurality of stator vanes 120. Notably, turbine rotor blades 118 (or buckets) are grouped in a plurality of annular, axially-spaced stages 122 that are rotatable on an axially-aligned rotor shaft 124, which is in turn rotatably coupled to rotor blades 114 of compressor 102. Similarly, stator vanes 120 (or nozzles) are grouped in a plurality of annular, axially-spaced stages 126 that are axially-interspaced with rotor stages 122. Notably, turbine 106 may have any suitable quantity of rotor stages 122 and stator stages 126 that facilitates enabling turbine assembly 100 to function as described herein.

During operation of turbine assembly 100, a working gas flow 128 (e.g., ambient air) enters compressor 102, wherein flow 128 is compressed and channeled into combustor 104. The resulting compressed flow 130 is mixed with fuel and ignited in combustor 104 to generate a combustion gas flow 132 that is channeled through turbine 106, before being discharged from turbine assembly 100 as an exhaust gas flow 134. More specifically, when combustion gas flow 132 is channeled through turbine 106, flow 132 displaces rotor blades 118 and drives rotor shaft 124, which in turn drives compressor rotor blades 114. Due at least in part to their direct contact with combustion gas flow 132, rotor blades 118 tend to be subjected to higher-temperature operating conditions than other turbine components, and it is therefore desirable to cool rotor blades 118 during operation of turbine assembly 100. To facilitate cooling blades 118, a portion of compressed gas flow 130 (i.e., a cooling gas (or purge) flow 136) is channeled through rotor shaft 124, such that cooling gas flow 136 bypasses combustor 104 and is subsequently channeled into each rotor blade 118 prior to it being injected into combustion gas flow 132 within turbine 106.

Figure 2:
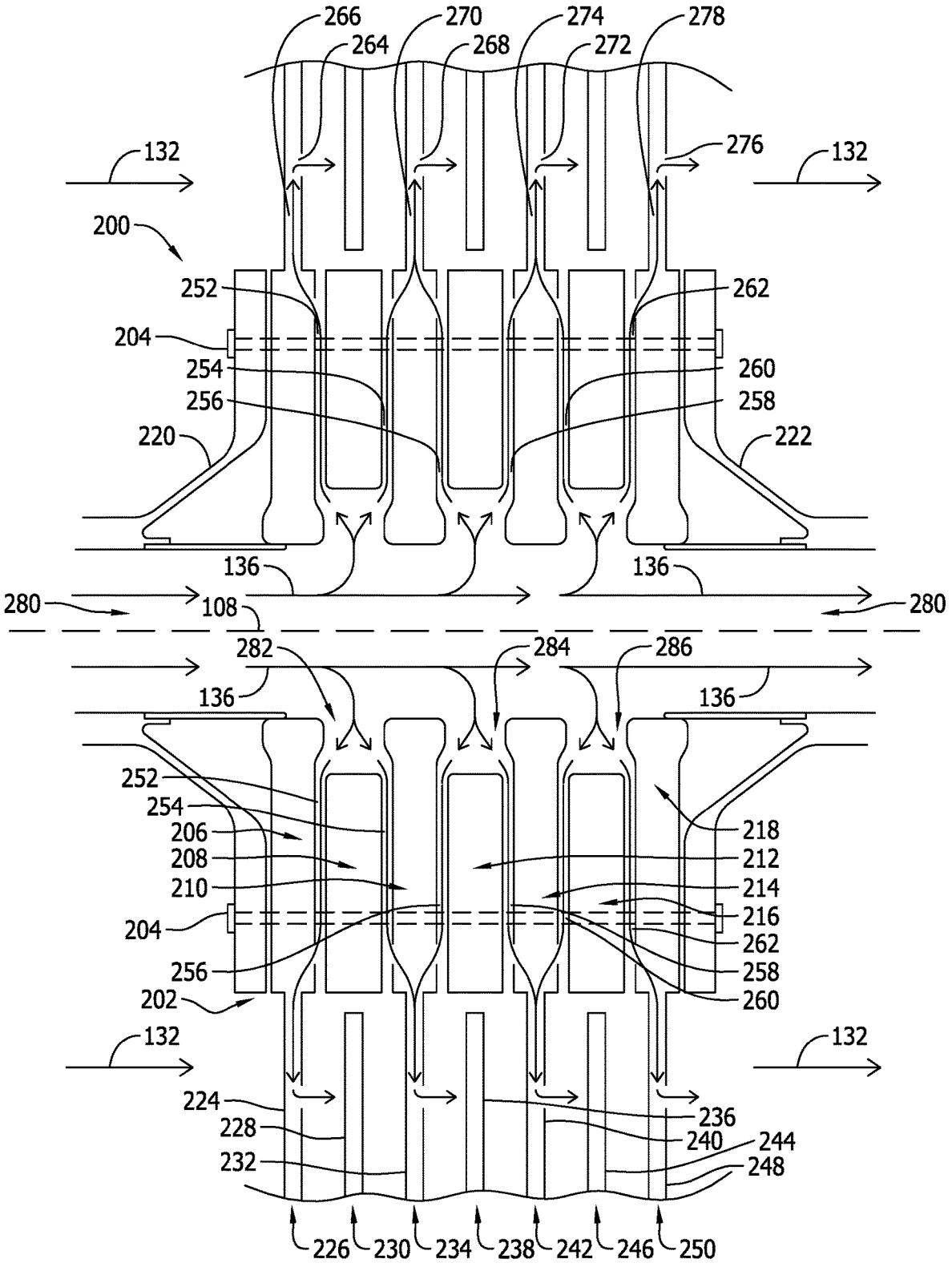
FIG. 2 is a schematic illustration of a portion of an exemplary turbine segment of a rotor shaft for use in the turbine assembly shown in FIG. 1.

FIG. 2 is a schematic illustration of an exemplary turbine segment 200. In the exemplary embodiment, turbine segment 200 includes a plurality of turbine discs 202 that are coupled together along axis 108 via a plurality of bolts 204. More specifically, in the exemplary embodiment, turbine segment 200 includes a first rotor disc 206, a first spacer disc 208, a second rotor disc 210, a second spacer disc 212, a third rotor disc 214, a third spacer disc 216, and a fourth rotor disc 218 that are arranged face-to-face in an axially sequential order and are coupled together between a first hub 220 and a second hub 222 via bolts 204. Although turbine segment 200 has four rotor discs and three spacer discs in the exemplary embodiment, turbine segment 200 may have any suitable number of rotor discs and spacer discs arranged in any suitable manner. As used herein, the term "turbine disc" refers to a disc of a rotor shaft segment that is axially-aligned with a turbine section (e.g., turbine 106) not a compressor section (e.g., not compressor 102).

In the exemplary embodiment, first rotor disc 206 is axially-aligned with, and radially coupled to, a plurality of circumferentially-spaced first rotor blades 224 of a first rotor stage 226 such that first rotor disc 206 rotates with first rotor blades 224. First spacer disc 208 is axially-aligned with, and radially spaced apart from, a plurality of circumferentially-spaced first stator vanes 228 of a first stator stage 230 such that first spacer disc 208 rotates relative to first stator vanes 228. Second rotor disc 210 is axially-aligned with, and radially coupled to, a plurality of circumferentially-spaced second rotor blades 232 of a second rotor stage 234 such that second rotor disc 210 rotates with second rotor blades 232. Second spacer disc 212 is axially-aligned with, and radially spaced apart from, a plurality of circumferentially-spaced second stator vanes 236 of a second stator stage 238 such that second spacer disc 212 rotates relative to second stator vanes 236. Third rotor disc 214 is axially-aligned with, and radially coupled to, a plurality of circumferentially-spaced third rotor blades 240 of a third rotor stage 242 such that third rotor disc 214 rotates with third rotor blades 240. Third spacer disc 216 is axially-aligned with, and radially spaced apart from, a plurality of circumferentially-spaced third stator vanes 244 of a third stator stage 246 such that third spacer disc 216 rotates relative to third stator vanes 244. Fourth rotor disc 218 is axially-aligned with, and radially coupled to, a plurality of circumferentially-spaced fourth rotor blades 248 of a fourth rotor stage 250 such that fourth rotor disc 218 rotates with fourth rotor blades 248.

In the exemplary embodiment, an array of circumferentially-spaced first cooling channels 252 are defined between first rotor disc 206 and first spacer disc 208, and an array of circumferentially-spaced second cooling channels 254 are defined between first spacer disc 208 and second rotor disc 210. Similarly, an array of circumferentially-spaced third cooling channels 256 are defined between second rotor disc 210 and second spacer disc 212, and an array of circumferentially-spaced fourth cooling channels 258 are defined between second spacer disc 212 and third rotor disc 214. Likewise, an array of circumferentially-spaced fifth cooling channels 260 are defined between third rotor disc 214 and third spacer disc 216, and an array of circumferentially-spaced sixth cooling channels 262 are defined between third spacer disc 216 and fourth rotor disc 218. Although each cooling channel 252, 254, 256, 258, 260, and 262 is illustrated as being linearly-extending and radially-oriented (i.e., oriented substantially perpendicular to axis 108) in the exemplary embodiment, each cooling channel 252, 254, 256, 258, 260, and 262 may have any suitable shape and/or orientation in other embodiments (e.g., cooling channels 252, 254, 256, 258, 260, and/or 262 may have a curved shape that is not radially-oriented).

In the exemplary embodiment, each first rotor blade 224 has at least one first cooling gas discharge port 264 and a first internal cooling circuit 266 that is in flow communication with first cooling gas discharge port(s) 264. Moreover, each second rotor blade 232 has at least one second cooling gas discharge port 268 and a second internal cooling circuit 270 that is in flow communication with second cooling gas discharge port(s) 268. Similarly, each third rotor blade 240 has at least one third cooling gas discharge port 272 and a third internal cooling circuit 274 that is in flow communication with third cooling gas discharge port(s) 272, and each fourth rotor blade 248 has at least one fourth cooling gas discharge port 276 and a fourth internal cooling circuit 278 that is in flow communication with fourth cooling gas discharge port(s) 276. Notably, each first cooling channel 252 is in flow communication with the first internal cooling circuit 266 of a first rotor blade 224. Each second cooling channel 254 is in flow communication with the second internal cooling circuit 270 of a second rotor blade 232, and each third cooling channel 256 is also in flow communication with the second internal cooling circuit 270 of a second rotor blade 232. Likewise, each fourth cooling channel 258 is in flow communication with the third internal cooling circuit 274 of a third rotor blade 240, and each fifth cooling channel 260 is also in flow communication with the third internal cooling circuit 274 of a third rotor blade 240. Each sixth cooling channel 262 is in flow communication with the fourth internal cooling circuit 278 of a fourth rotor blade 248.

In the exemplary embodiment, a central conduit 280 is defined along segment 200 to enable cooling gas flow 136 to be channeled axially along rotor shaft 124. First rotor disc 206, first spacer disc 208, and second rotor disc 210 collectively define a first circumferential plenum 282 through which cooling gas flow 136 is channeled from central conduit 280. Likewise, second rotor disc 210, second spacer disc 212, and third rotor disc 214 collectively define a second circumferential plenum 284 through which cooling gas flow 136 is channeled from central conduit 280. Also, third rotor disc 214, third spacer disc 216, and fourth rotor disc 218 collectively define a third circumferential plenum 286 through which cooling gas flow 136 is channeled from central conduit 280. First circumferential plenum 282 is in flow communication with first cooling channel(s) 252 and second cooling channel(s) 254; second circumferential plenum 284 is in flow communication with third cooling channel(s) 256 and fourth cooling channel(s) 258; and third circumferential plenum 286 is in flow communication with fifth cooling channel(s) 260 and sixth cooling channel(s) 262. Alternatively, plenums 282, 284, and/or 286 may have any suitable shape and any suitable orientation (e.g., plenums 282, 284, and/or 286 may not be circumferential in some embodiments).

During operation of turbine assembly 100, cooling gas flow 136 from central conduit 280 enters cooling channels 252, 254, 256, 258, 260, and 262 via circumferential plenums 282, 284, and 286, respectively. More specifically, cooling gas flow 136 enters each first cooling channel 252 and each second cooling channel 254 via first circumferential plenum 282, cooling gas flow 136 enters each third cooling channel 256 and each fourth cooling channel 258 via second circumferential plenum 284, and cooling gas flow 136 enters each fifth cooling channel 260 and each sixth cooling channel 262 via third circumferential plenum 286.

Cooling gas flow 136 from cooling channels 252, 254, 256, 258, 260, and 262 is then channeled into internal cooling circuits 266, 270, 274, and 278 of respective rotor blades 224, 232, 240, and 248. More specifically, cooling gas flow 136 from each first cooling channel 252 enters the first internal cooling circuit 266 of a first rotor blade 224. Cooling gas flow 136 from each second cooling channel 254 enters the second internal cooling circuit 270 of a second rotor blade 232, and cooling gas flow 136 from each third cooling channel 256 also enters the second internal cooling circuit 270 of a second rotor blade 232. Likewise, cooling gas flow 136 from each fourth cooling channel 258 enters the third internal cooling circuit 274 of a third rotor blade 240, and cooling gas flow 136 from each fifth cooling channel 260 also enters the third internal cooling circuit 274 of a third rotor blade 240. Cooling gas flow 136 from each sixth cooling channel 262 enters the fourth internal cooling circuit 278 of a fourth rotor blade 248.

Cooling gas flow 136 from internal cooling circuits 266, 270, 274, and 278 is then discharged from rotor blades 224, 232, 240, and 248 via cooling gas discharge ports 264, 268, 272, and 276, respectively. More specifically, cooling gas flow 136 from each first internal cooling circuit 266 is discharged from its respective first cooling gas discharge port(s) 264 into combustion gas flow 132, and cooling gas flow 136 from each second internal cooling circuit 270 is discharged from its respective second cooling gas discharge port(s) 268 into combustion gas flow 132. Likewise, cooling gas flow 136 from each third internal cooling circuit 274 is discharged from its respective third cooling gas discharge port(s) 272 into combustion gas flow 132, and cooling gas flow 136 from each fourth internal cooling circuit 278 is discharged from its respective fourth cooling gas discharge port(s) 276 into combustion gas flow 132.

Figure 3:
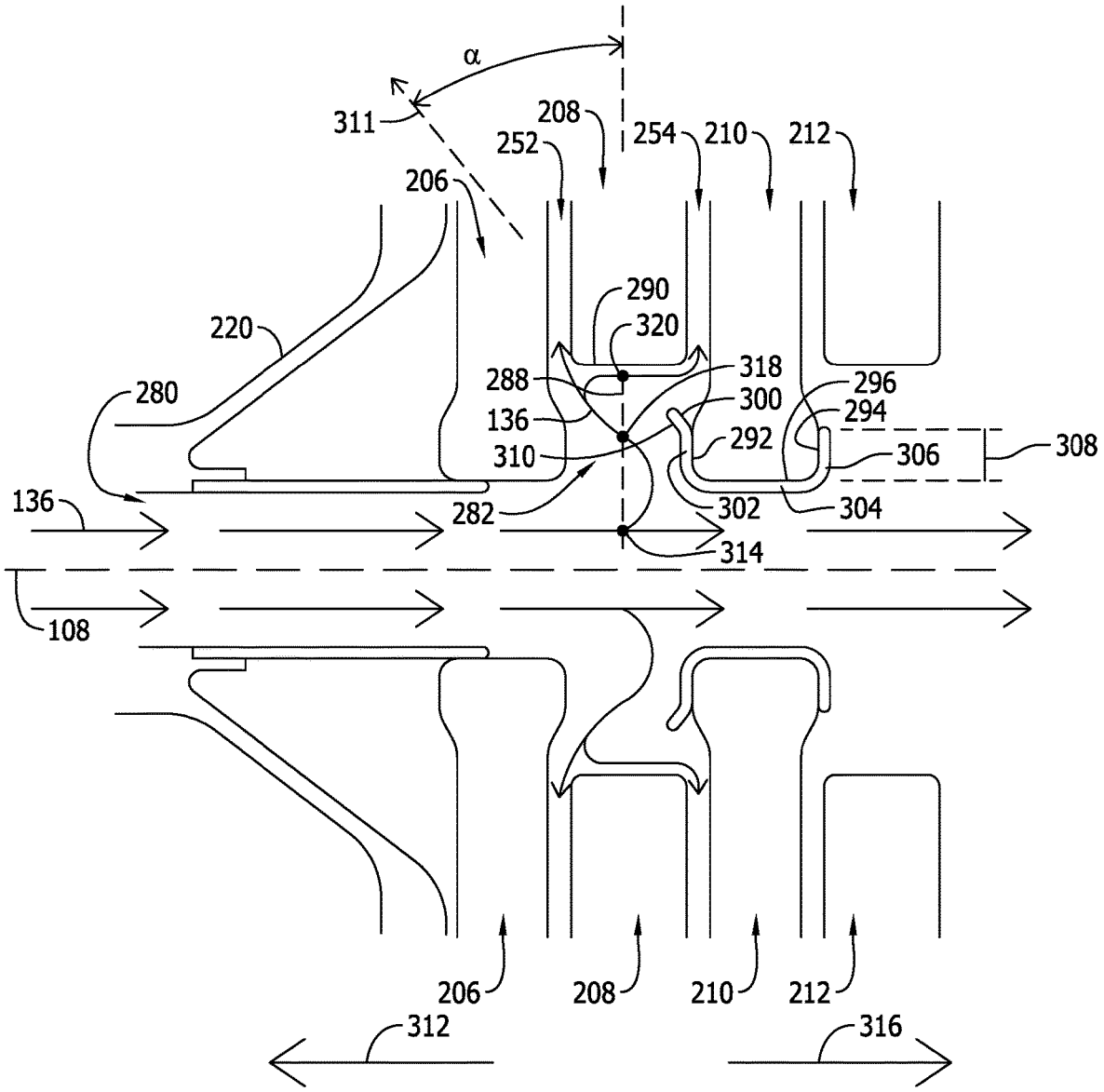
FIG. 3 is an enlarged portion of the turbine segment shown in FIG. 3.

FIG. 3 is an enlarged portion of turbine segment 200. In the exemplary embodiment, each circumferential plenum 282, 284, and 286 has a radius 288 that extends from axis 108 to the associated spacer disc 208, 212, or 216 between the associated cooling channels 252 and 254, or 256 and 258, or 260 and 262, respectively. For example, as shown in FIG. 3, radius 288 of first circumferential plenum 282 extends from axis 108 to a radially inner surface 290 of first spacer disc 208 between a first cooling channel 252 and a second cooling channel 254. Radius 288 of second circumferential plenum 284 (not shown) is oriented similarly in relation to second spacer disc 212, a third cooling channel 256, and a fourth cooling channel 258, and radius 288 of third circumferential plenum 286 (not shown) is oriented similarly in relation to third spacer disc 216, a fifth cooling channel 260, and a sixth cooling channel 262.

In the exemplary embodiment, each of second rotor disc 210, third rotor disc 214, and fourth rotor disc 218 has a forward side surface 292, a rearward side surface 294, and a radially inner surface 296 that extends from forward side surface 292 to rearward side surface 294. At least one of second rotor disc 210, third rotor disc 214, and fourth rotor disc 218 has a deflector 300 that is either formed integrally therewith or coupled thereto. For example, as shown in FIG. 3, deflector 300 is coupled to second rotor disc 210 via an integrally formed forward retainer flange 302 that extends along forward side surface 292, an integrally formed bushing 304 that extends from forward retainer flange 302 downstream along inner surface 296 and central conduit 280, and an integrally formed rearward retainer flange 306 that extends from bushing 304 along rearward side surface 294. Notably, deflector 300 is spaced a distance 308 radially outward from inner surface 296, and deflector 300 has a deflection surface 310 that is oriented in a direction that is in part radially outward and in part forward to form an acute angle $\alpha$ relative to radius 288. As used herein, the term "forward" refers to a direction 312 that is oriented towards compressor 102 parallel with axis 108, and the term "rearward" refers to a direction 316 that is oriented away from compressor 102 parallel with axis 108.

Although deflector 300, forward retainer flange 302, bushing 304, and rearward retainer flange 306 are integrally formed together in the exemplary embodiment, deflector 300, forward retainer flange 302, bushing 304, and rearward retainer flange 306 may be coupled together in any suitable manner in other embodiments. Moreover, although deflector 300, forward retainer flange 302, bushing 304, and rearward retainer flange 306 are circumferential in the exemplary embodiment, deflector 300, forward retainer flange 302, bushing 304, and/or rearward retainer flange 306 may not be circumferential in other embodiments. Alternatively, deflector 300 may be coupled to second rotor disc 210 in any suitable manner (i.e., deflector 300 may not be coupled to second rotor disc 210 using forward retainer flange 302, bushing 304, and rearward retainer flange 306).

During operation of turbine assembly 100, deflector(s) 300 facilitate a better distribution of cooling gas flow 136 amongst cooling channels 252, 254, 256, 258, 260, and 262. For example, as shown in FIG. 3, deflector 300 of second rotor disc 210 facilitates preventing an excessive amount of cooling gas flow 136 from entering second cooling channel(s) 254 by deflecting cooling gas flow 136 generally forward towards first cooling channel(s) 252. More specifically, because deflection surface 310 is oriented at acute angle $\alpha$ relative to radius 288, cooling gas flow 136 entering first circumferential plenum 282 is deflected generally forward towards first cooling channel(s) 252 to facilitate ensuring that first cooling channel(s) 252 are provided with a sufficient amount of cooling gas, which promotes adequate cooling of first rotor blades 224. Thus, cooling gas flow 136 entering first cooling channel(s) 252 crosses radius 288 at two different radial locations, namely at a first radial location 314 (while flowing generally rearward) and at a second radial location 318 (while flowing generally forward) that is spaced radially outward from first radial location 314. Moreover, cooling gas flow 136 entering second cooling channel(s) 254 crosses radius 288 at three different radial locations, namely at first radial location 314 (while flowing generally rearward), at second radial location 318 (while flowing generally forward), and again at a third radial location 320 (while flowing generally rearward) that is spaced radially outward from second radial location 318. As a result, cooling gas flow 136 has a generally S-shaped flow path (as shown in FIG. 3) within first circumferential plenum 282. If a deflector 300 is integrally formed with or coupled to third rotor disc 214 and/or fourth rotor disc 218 in a similar manner, cooling gas flow 136 within second circumferential plenum 284 and third circumferential plenum 286, respectively, has a similar flow path that is generally S-shaped.

The methods and systems described herein facilitate cooling turbine rotor blades of a gas turbine assembly. More specifically, the methods and systems facilitate distributing cooling gas amongst turbine rotor blades to ensure that each rotor blade is adequately cooled (particularly the rotor blades in the first rotor stage of the turbine). For example, the methods and systems facilitate providing a deflector within a plenum to deflect cooling gas towards a forward cooling channel associated with the plenum, thereby preventing an excessive amount of cooling gas from entering a rearward cooling channel associated with the plenum. As a result, the methods and systems facilitate ensuring that turbine rotor blades are properly cooled during operation of a gas turbine assembly, thereby reducing the likelihood that the turbine rotor blades experience heat-related fracture, which in turn improves the useful life of the turbine rotor blades.

Exemplary embodiments of turbine discs are described above in detail. The methods and systems described herein are not limited to the specific embodiments described herein, but rather, components of the methods and systems may be utilized independently and separately from other components described herein. For example, the methods and systems described herein may have other applications not limited to practice with gas turbine assemblies, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A turbine disc assembly comprising:

a first rotor disc;

a second rotor disc having an inner surface and a bushing coupled to the inner surface; and a spacer disc coupled between said first and second rotor discs along an axis to define a plenum, said spacer disc having an inner surface with a radius from the axis, wherein a first cooling channel defined between said first rotor disc and said spacer disc is in flow communication with said plenum, said second rotor disc comprises a deflector having a deflection surface positioned within said plenum such that said deflection surface is oriented towards the first cooling channel at an acute angle relative to the radius of said inner surface of said spacer disc said deflector formed integrally with said second rotor disc.

2. A turbine disc assembly in accordance with claim 1, wherein a second cooling channel is defined between said second rotor disc and said spacer disc.

3. A turbine disc assembly in accordance with claim 1, wherein said second rotor disc comprises a side surface, said deflector formed integrally with said side surface.

4. A turbine disc assembly in accordance with claim 1, wherein said second rotor disc comprises a first side surface and a second side surface, said inner surface extending between said first side surface and said second side surface, said bushing coupled to said inner surface of said second rotor disc.

5. A turbine disc assembly in accordance with claim 1, wherein said deflector extends circumferentially around the axis.

6. A method of fabricating a turbine disc assembly, said method comprising:

forming a first rotor disc;

forming a second rotor disc such that the second rotor disc includes a deflector having a deflection surface, wherein the deflector is formed integrally with the second rotor disc, and wherein forming the second rotor disc comprises:

forming the second rotor disc such that the second rotor disc has an inner surface; and coupling a bushing to the inner surface of the second rotor disc such that the bushing extends along the inner surface of the second rotor disc;

forming a spacer disc such that the spacer disc has an inner surface; and coupling the spacer disc between the first and second rotor discs along an axis to define a plenum wherein a radius is defined from the axis to the inner surface of the spacer disc, such that a first cooling channel defined between the first rotor disc and the spacer disc is in flow communication with the plenum, and such that the deflection surface is positioned within the plenum and is oriented towards the first cooling channel at an acute angle relative to the radius of the inner surface of the spacer disc.

7. A method in accordance with claim 6, wherein coupling the spacer disc between the first rotor disc and the second rotor disc comprises coupling the second rotor disc to the spacer disc such that a second cooling channel is defined between the second rotor disc and the spacer disc.

8. A method in accordance with claim 6, wherein forming a second rotor disc comprises forming the second rotor disc such that the second rotor disc has a side surface and such that the deflector is formed integrally with the side surface.

9. A method in accordance with claim 6, wherein forming a second rotor disc comprises:

forming the second rotor disc such that the second rotor disc has a first side surface, a second side surface, and the inner surface extending-between the first side surface and the second side surface; and coupling the bushing to the inner surface of the second rotor disc to extend along the inner surface of the second rotor disc.

10. A method in accordance with claim 6, wherein forming a second rotor disc comprises forming the deflector such that the deflector extends circumferentially around the axis.

11. A gas turbine assembly comprising:

a compressor comprising a plurality of compressor rotor blades;

a turbine comprising a plurality of turbine rotor blades, wherein each of said turbine rotor blades has an internal cooling circuit; and a rotor shaft rotatably coupling said turbine rotor blades to said compressor rotor blades, wherein said compressor is in flow communication with said internal cooling circuits of said turbine rotor blades across said rotor shaft, said rotor shaft having a turbine segment comprising:

a first rotor disc;

a second rotor disc including an inner surface and a bushing coupled to said inner surface; and a spacer disc coupled between said first and second rotor discs along an axis to define a plenum, said spacer disc having an inner surface with a radius from the axis, wherein a first cooling channel is defined between said first rotor disc and said spacer disc such that the first cooling channel is in flow communication with said plenum and the internal cooling circuit of one of said turbine rotor blades, said second rotor disc comprises a deflector having a deflection surface positioned within said plenum such that said deflection surface is oriented towards the first cooling channel at an acute angle relative to the radius of said inner surface of said spacer disc, said deflector formed integrally with said second rotor.

12. A gas turbine assembly in accordance with claim 11, wherein a second cooling channel is defined between said second rotor disc and said spacer disc.

13. A gas turbine assembly in accordance with claim 11, wherein said second rotor disc comprises a side surface, said deflector formed integrally with said side surface.

14. A gas turbine assembly in accordance with claim 11, wherein said second rotor disc comprises a first side surface and a second side surface, and said inner surface extending between said first side surface and said second side surface, said bushing coupled to said inner surface of said second rotor disc.

15. A gas turbine assembly in accordance with claim 11, wherein said deflector extends circumferentially around the axis.

16. A gas turbine assembly in accordance with claim 11, wherein each of said turbine rotor blades comprises a cooling gas discharge port that is in flow communication with its respective internal cooling circuit.

17. A gas turbine assembly in accordance with claim 11, wherein said turbine segment further comprises a first hub, a second hub, and a plurality of bolts, such that said first turbine rotor disc, said second turbine rotor disc, and said spacer disc are coupled together between said first hub and said second hub via said bolts.

* * * * *